US009067100B2

(12) United States Patent
Habing

(10) Patent No.: US 9,067,100 B2
(45) Date of Patent: Jun. 30, 2015

(54) DUAL RESISTANCE EXERCISE APPARATUS

(75) Inventor: Theodore G. Habing, Tustin, CA (US)

(73) Assignee: Dream Visions, LLC, Tustin, CA (US)

( * ) Notice: Subject to any disclaimer, the term of this patent is extended or adjusted under 35 U.S.C. 154(b) by 706 days.

(21) Appl. No.: 13/229,175

(22) Filed: Sep. 9, 2011

(65) Prior Publication Data

US 2013/0065737 A1 Mar. 14, 2013

(51) Int. Cl.
*A63B 21/062* (2006.01)
*A63B 21/00* (2006.01)

(52) U.S. Cl.
CPC ..... *A63B 21/062* (2013.01); *A63B 21/156* (2013.01)

(58) Field of Classification Search
CPC ..... A63B 15/00; A63B 21/02; A63B 21/06; A63B 21/062; A63B 21/0615; A63B 21/156; A63B 21/0623; A63B 21/0613; A63B 21/0614; A63B 21/0626; A63B 21/15; A63B 21/151; A63B 21/154; A63B 2021/0624; A63B 2021/0626
USPC ..... 482/92–94, 98–103, 908
See application file for complete search history.

(56) References Cited

U.S. PATENT DOCUMENTS

| | | | | |
|---|---|---|---|---|
| 4,402,504 | A | 9/1983 | Christian | |
| 6,394,935 | B1 * | 5/2002 | Lake | 482/94 |
| 7,651,443 | B1 * | 1/2010 | Fenster et al. | 482/37 |
| 2007/0037674 | A1 * | 2/2007 | Finn et al. | 482/97 |
| 2012/0065035 | A1 * | 3/2012 | Makula | 482/129 |

FOREIGN PATENT DOCUMENTS

| | | | | |
|---|---|---|---|---|
| WO | WO 2012012578 A2 * | 7/2011 | | 482/102 |

* cited by examiner

*Primary Examiner* — Oren Ginsberg
*Assistant Examiner* — Nyca T Nguyen
(74) *Attorney, Agent, or Firm* — Blakely Sokoloff Taylor & Zafman LLP

(57) ABSTRACT

An apparatus for communicating exercise resistance includes a carriage assembly with at least one upper and at least one lower pulley. First and second cable ends are reeved around the upper and lower pulleys, respectively, and are coupled to a source of selectable exercise resistance. An exercise member is selectively coupled to the two cable ends such that movement of the exercise member away from the carriage is subject to a first exercise resistance when only one of the cable ends is attached and is subject to a second, greater exercise resistance when both cable ends are attached.

9 Claims, 7 Drawing Sheets

DUAL RESISTANCE EXERCISE APPARATUS

BACKGROUND OF THE INVENTION

1. Field of the Invention

The present invention relates generally to the field of exercise equipment. More particularly, the invention relates to an exercise device having a cable and pulley system that offers two different levels of resistance at a pull point, independent of the amount of weight selected.

2. Background

Exercise equipment having a cable and pulley system for lifting a stack of weights has been in use for well over a century. Such equipment comes in a wide variety of designs for performing various exercises. One type of such exercise equipment, exemplified, for example, in U.S. Pat. No. 4,402,504, is particularly suited for upper body exercises. This apparatus has an elongated upstanding frame and a carriage that is movable up and down along vertical posts of the frame. The carriage includes one or more pulleys around which a cable is reeved. The cable is further reeved around upper and/or lower pulleys on the frame and is coupled to a source of exercise resistance, such as a plurality of stacked weights. The cable exits the pulley on the carriage and is connected to a handle or similar pulling device. The height of the handle is readily adjustable by moving the carriage on the vertical posts and locking it into position at the selected height. This permits a wide variety of exercises to be performed for exercising muscle groups of the arms and upper body. The amount of exercise resistance is adjusted by selecting more or fewer stacked weights. The range of available exercise resistance is thus determined by the quantity of available weights.

It would be desirable to have exercise resistance selectable over a greater range without requiring a correspondingly greater number of stacked weights.

SUMMARY OF THE INVENTION

The present invention provides an apparatus for communicating exercise resistance comprising a carriage assembly with at least one upper and at least one lower pulley. First and second cable ends are reeved around the upper and lower pulleys, respectively, and are coupled to a source of selectable exercise resistance. An exercise member is selectively coupled to the two cable ends such that movement of the exercise member away from the carriage is subject to a first exercise resistance when only one of the cable ends is attached and is subject to a second, greater exercise resistance when both cable ends are attached.

In another embodiment, a set of upper and lower pulleys on a first carriage assembly have a cable end extending between the pulleys and another cable end attached to the carriage by a removable spring clip. The cable ends are coupled to a source of selectable exercise resistance. The cable end extending between the pulleys may be used with exercise handles or bars. An exercise member is associated with a second carriage assembly above or below the first carriage assembly. The cable end extending between the upper and lower pulleys can attach to the second carriage to provide a first exercise resistance to the exercise member. If more resistance is desired, the cable end attached to the first carriage may be removed from the first carriage and attached to the second carriage, providing a greater resistance.

DETAILED DESCRIPTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
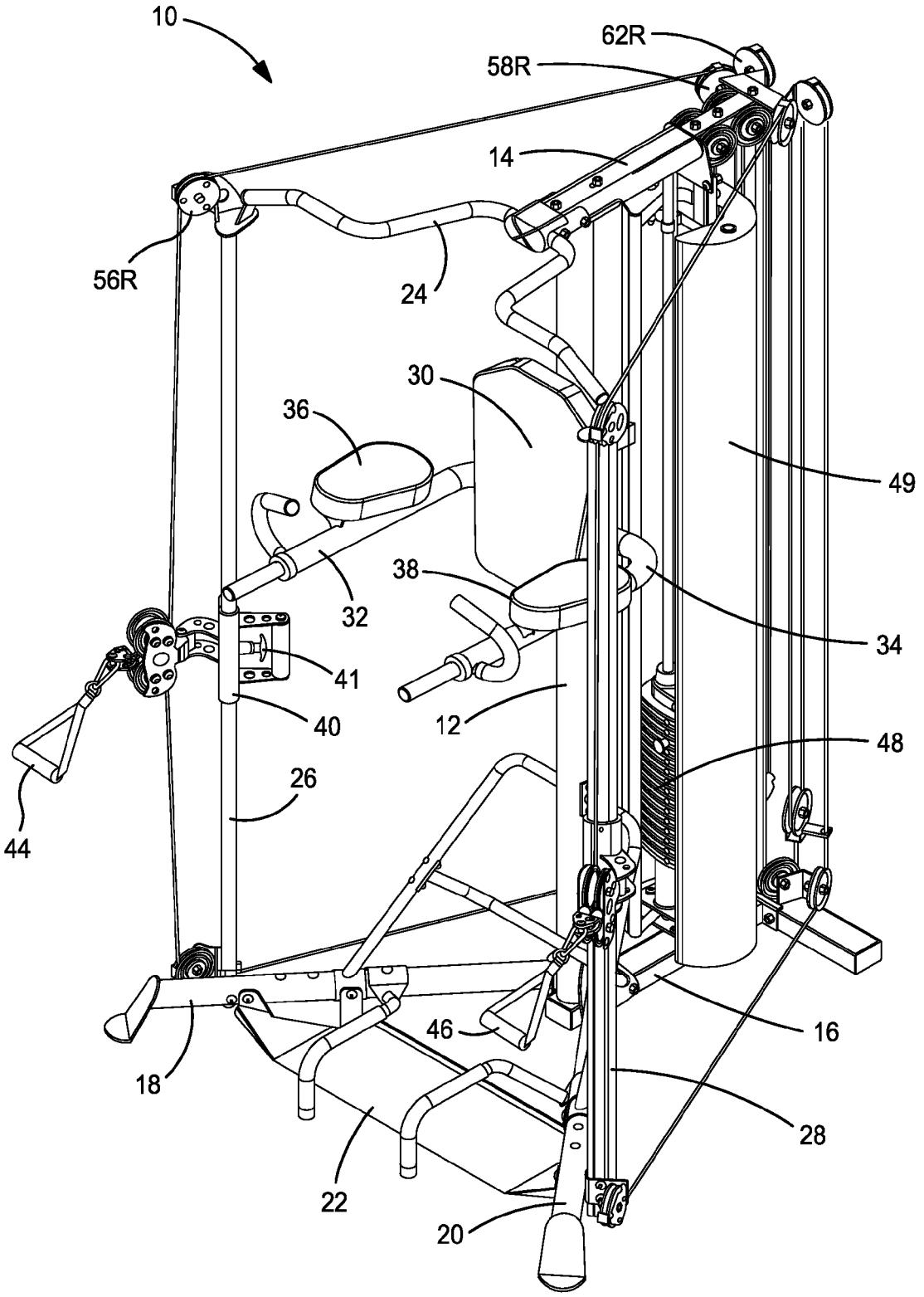
FIG. 1 is a perspective view of an exercise apparatus incorporating an embodiment of the present invention.

Referring first to FIG. 1, exercise apparatus 10 has a frame comprising a central upright 12, top member 14, base member 16 and legs 18 and 20. Footplate 22 is attached between legs 18 and 20. A lat bar assembly 24 is attached to top member 14. Selector tubes 26, 28 are attached between lat bar assembly 24 and leg 18 and between lat bar assembly 24 and leg 20, respectively.

Backrest cushion 30 is attached to central upright 12, as are right handlebar assembly 32 and left handlebar assembly 34. Arm cushions 36, 38 are attached to handlebar assemblies 32, 34, respectively.

Carriage assembly 40 is slidably mounted on selector tube 26 and may be positioned at any desired height by means of pull pin 41 engaging with one of a plurality of holes (not shown) in the selector tube. Carriage assembly 42 is similarly slidably mounted on selector tube 28. A variety of weight resistance exercises may be performed using handles 44 and 46 that are operatively associated with carriage assemblies 40 and 42, respectively, as more fully described below. Exercise resistance is furnished by a selectorized weight stack 48. A shroud 49 may partially enclose weight stack 48.

Figure 2:
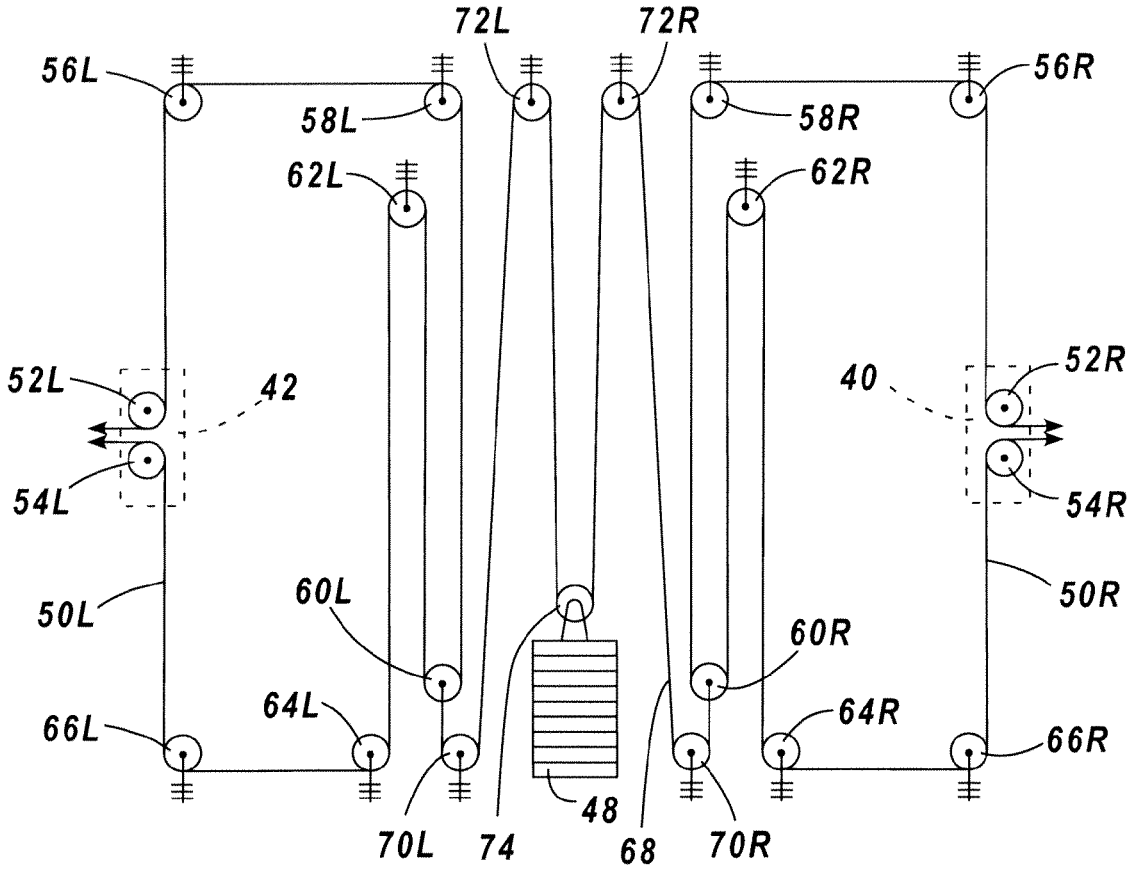
FIG. 2 diagrammatically illustrates the cable and pulley arrangement of the exercise apparatus shown in FIG. 1.

Referring also to FIG. 2, the cable and pulley arrangement of apparatus 10 will be described. Looking to the right side of the figure, pulleys 52R and 54R are rotatably mounted on carriage assembly 40. The two ends of cable 50R are reeved around these two pulleys and are coupled to handle 44, as will be explained below. Continuing up from pulley 52R, cable 50R is reeved around a fixed high pulley 56R and then around another high fixed pulley 58R. Cable 50R then travels downwardly around floating pulley 60R and then upwardly around high fixed pulley 62R. Cable 50R continues down around low fixed pulley 64R and then around low fixed pulley 66R. From there, cable 50R travels upwardly and is reeved around pulley 54R. The cable and pulley arrangement on the left side of the apparatus is a mirror image of that just described.

Cable 68 is attached to floating pulley 60R and travels down and around low fixed pulley 70R. Cable 68 then travels upwardly and around high fixed pulley 72R and then back down and around pulley 74 on the top of weight stack 48. Again, the left side of the apparatus is a mirror image with cable 68 travelling upwardly from pulley 74, around high fixed pulley 72L, then downwardly and around low fixed pulley 70L, and then upwardly to where it is attached to floating pulley 60L.

From FIG. 2, it can be seen that pulling on either end of cable 50R, or on either end of cable 50L, will be resisted by one-fourth of the weight of weight stack 48. Pulling on both ends of cable 50R simultaneously, or on both ends of cable 50L simultaneously, will be resisted by one-half of the weight of weight stack 48.

Figure 3:
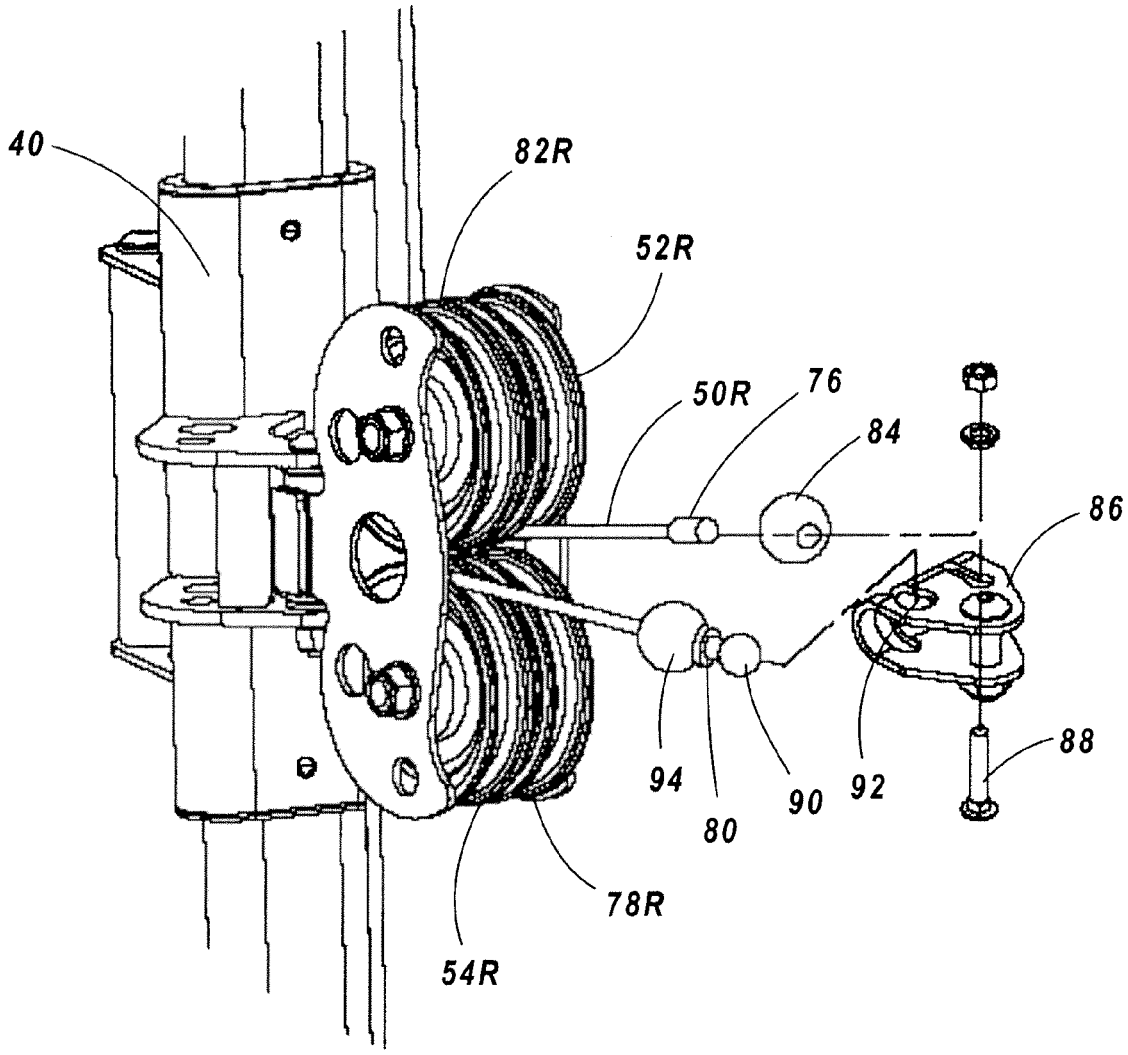
FIG. 3 is a detailed view of a carriage assembly and cable bracket in accordance with an embodiment of the present invention.
Figure 4:
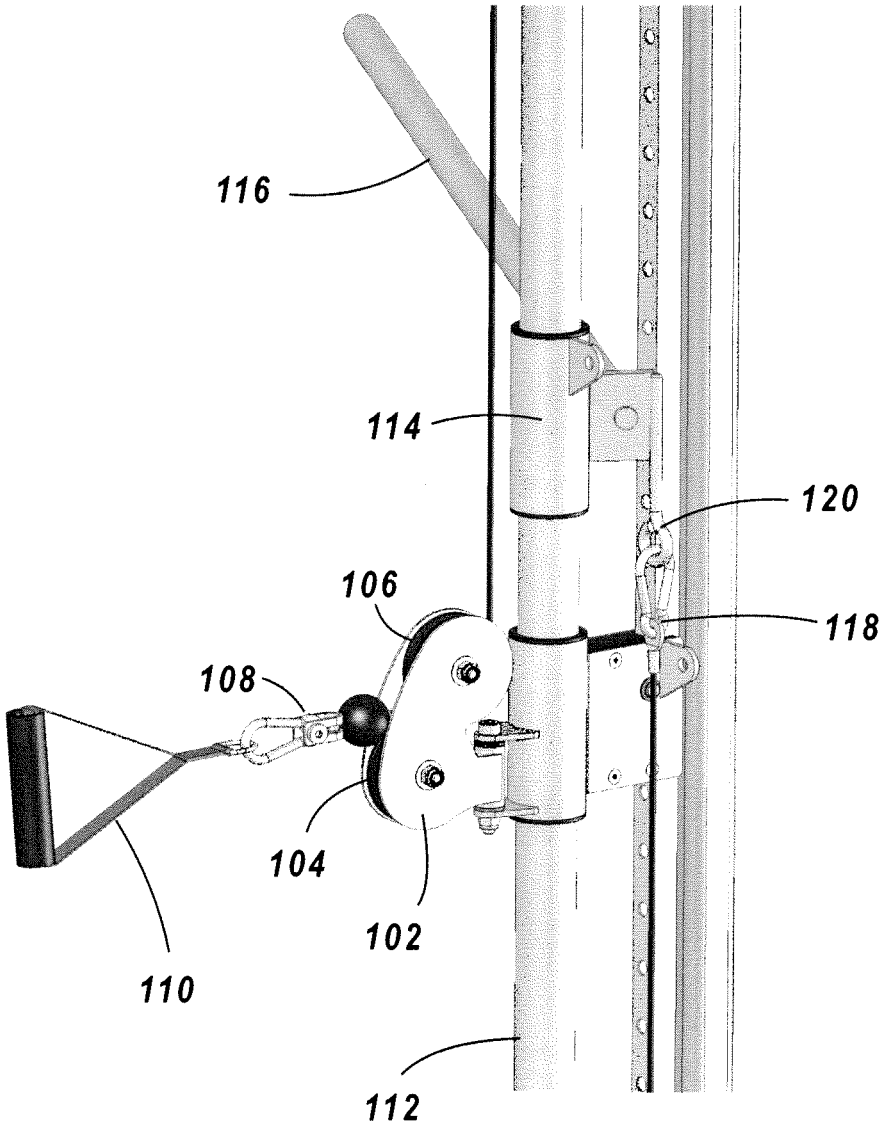
FIG. 4 is a partial perspective view of an exercise apparatus incorporating another embodiment of the present invention.

Details of right side carriage assembly 40 are shown in FIG. 3. It will be understood that left side carriage assembly 42 is a mirror image of assembly 40. A first end 76 of cable 50R exits between a first upper pulley 52R on carriage assembly 40 and a first lower pulley 78R. Similarly, a second end 80 of cable 50R exits between a second upper pulley 82R and a second lower pulley 54R. The first end 76 of cable 50R is inserted through ball stop 84 and is secured to bracket 86 by bolt 88. The second end 80 of cable 50R has a small ball fitting 90 that may be inserted into slot 92 of bracket 86. If the second end 80 is not secured to the bracket 86, it is retained between pulleys 82R and 54R by ball stop 94. Handle 44 (shown in FIG. 1) is coupled to a bracket 86. As previously explained, the first end 76 of cable 50R is secured to bracket 86, so that pulling on the handle will draw out cable 50R from between pulleys 52R and 78R. Pulling in this manner will be resisted by one-quarter of the weight of weight stack 48. If ball 90 is inserted into slot 92, thereby securing the second end 80 of cable 50R to bracket 86, pulling on handle 44 will be resisted by one-half of the weight of weight stack 48. When using one cable end (¼ resistance), the user gets twice the amount of cable travel as when using both cable ends (½ resistance). Functional exercises that simulate body movements of sports activities movements require more travel, whereas traditional training exercises such as lat pull downs require more resistance.

In a variation of the above-described embodiment, the carriage assemblies could each have two pulleys instead of four. In this case, it would be preferred that the two pulleys would be slightly offset from each other axially so that the cable from either pulley would clear the other pulley during use. In this variation, the upper end of the cable would be reeved around the upper pulley and the lower end of the cable would be reeved around the lower pulley. For example, this could be accomplished by modifying carriage assembly 40 shown in FIG. 3 to omit pulleys 78R and 82R. Suitable cable guides or brackets could then be provided to interface with ball stops 84 and 94 to prevent the cable ends from slipping past pulleys 52R and 54R. As in the previously described embodiment, each cable end could be used independently or together to achieve a desired resistance ratio.

Figure 5:
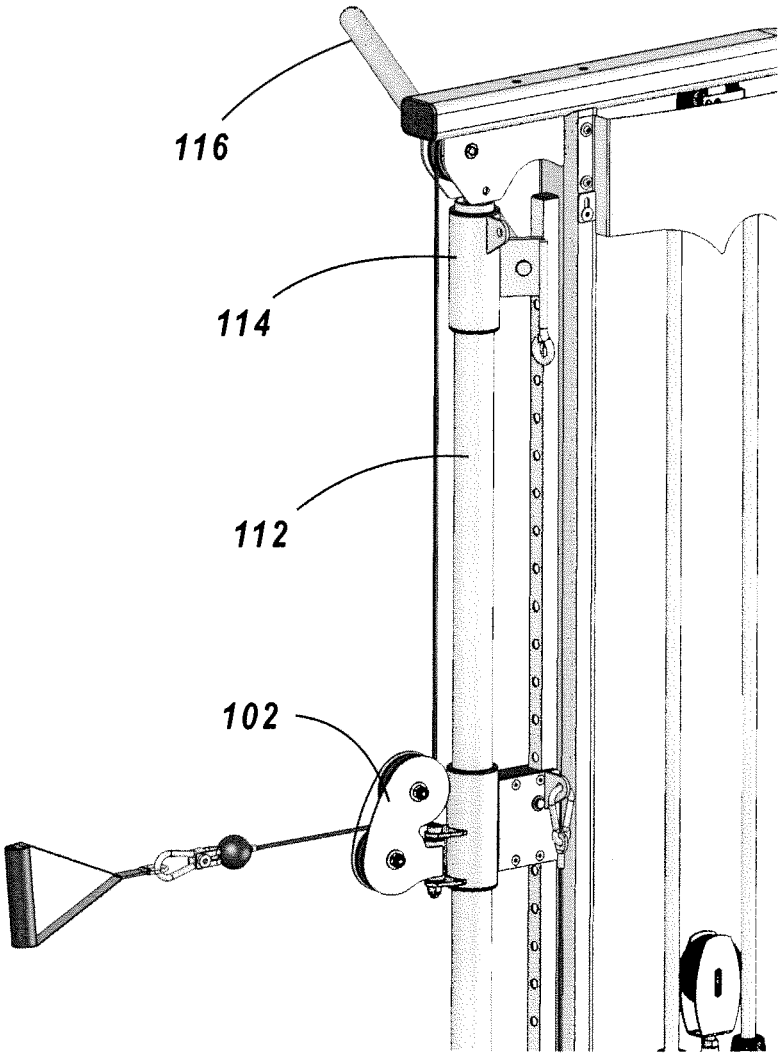
FIG. 5 is another view of the apparatus of FIG. 4.

Another embodiment of the present invention is illustrated in FIGS. 4-7. A first carriage assembly 102 has a pair of pulleys 104, 106 rotatably mounted thereon. First cable end 108 exits between pulleys 104 and 106 and may be coupled to a handle 110 or a bar (not shown) for performing various exercises. The first carriage assembly 102 is adjustable up and down a slider shaft 112 and is lockable at various positions along the slider shaft. A second carriage assembly 114 is disposed on slider shaft 112 above the first carriage assembly 102. The second carriage assembly 114 has an exercise press bar 116 associated with it. A second cable end 118 is releasably attached to eye 120 on the second carriage assembly 114. The second carriage assembly slides up and down the slider shaft and may be locked in a stowed position at the top of the slider shaft when not in use as shown in FIG. 5. It should be understood that an exercise apparatus incorporating this embodiment of the invention will preferably have two of the previously described arrangements—one each for the left and right sides of the body.

Figure 6:
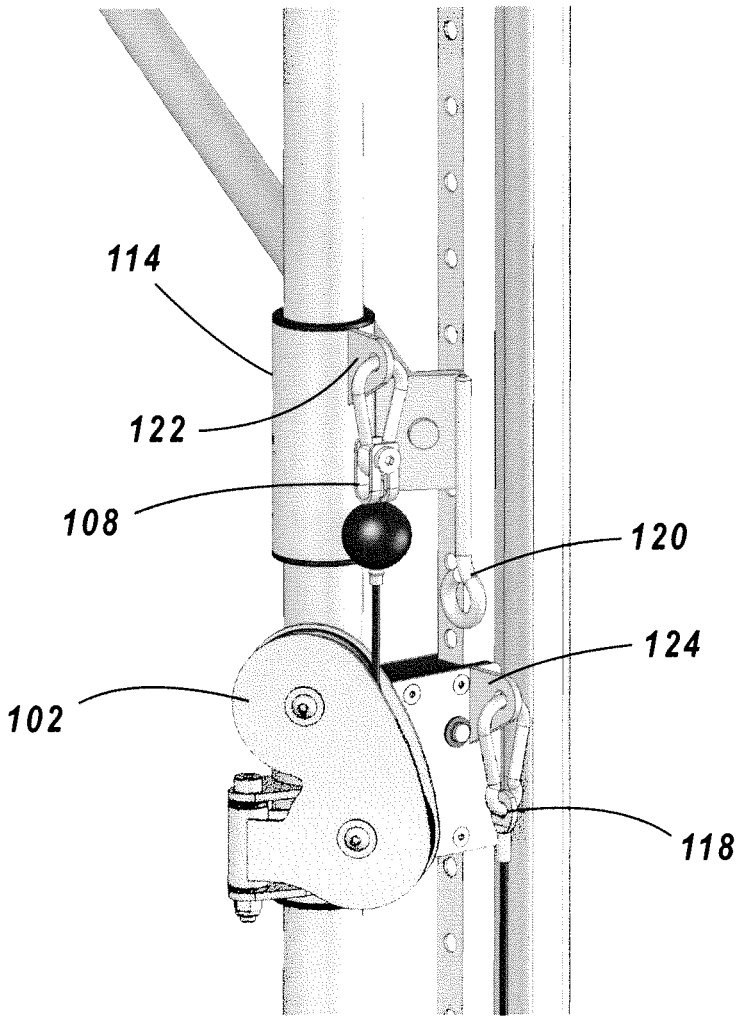
FIG. 6 is another view of the apparatus of FIG. 4.
Figure 7:
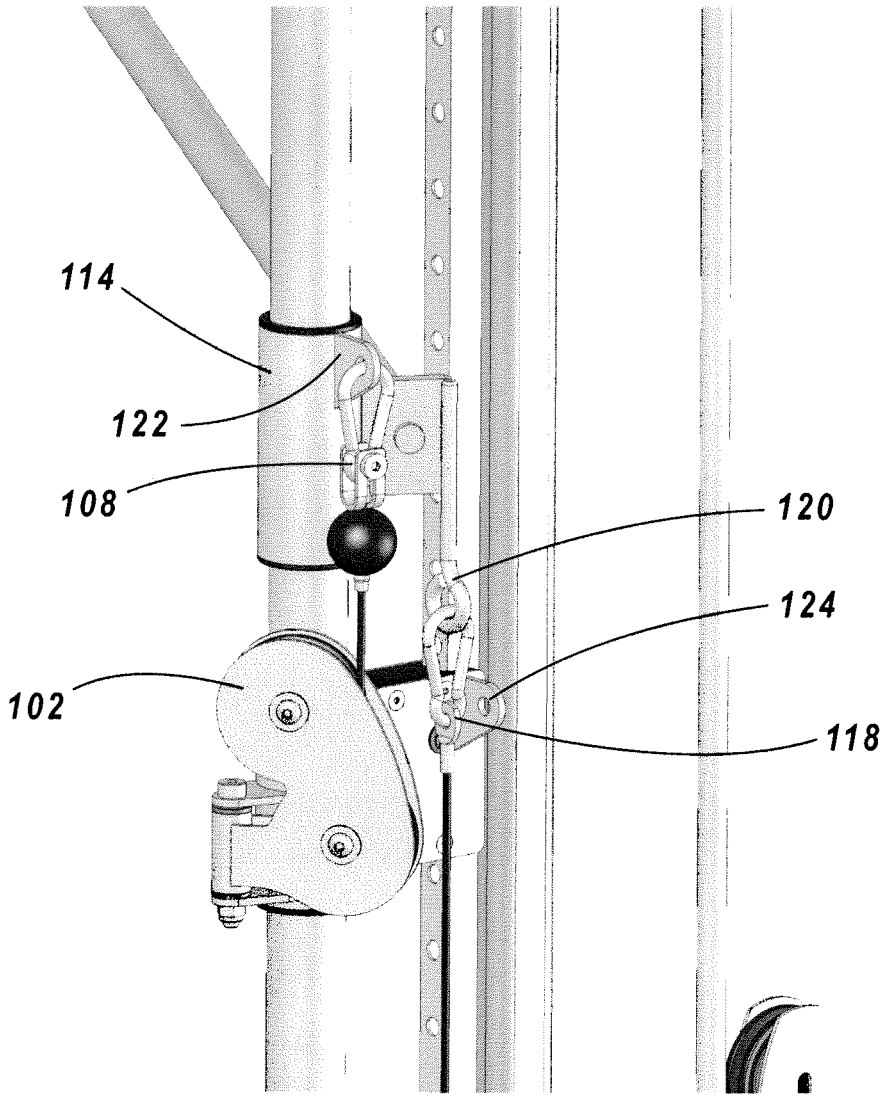
FIG. 7 is another view of the apparatus of FIG. 4.

When using the press bar 116 associated with the second carriage assembly, the second carriage assembly 114 is lowered from its stowed position at the top of the slider shaft and rested on top of the first carriage assembly 102. Attaching the first cable end to eye 122 on the second carriage assembly 114 with the second cable end attached to eye 124 on the first carriage assembly 102 as shown in FIG. 6 provides a first exercise resistance to the press bar. Attaching the second cable end to eye 120 on the second carriage assembly as shown in FIG. 7 provides a second, greater resistance to the press bar.

The configuration shown in FIGS. 4-7 could be reversed with the second carriage assembly located below the first carriage assembly, in which case an exercise bar attached to the second carriage assembly could be used as a pull bar. In this case, the stowed position for the second carriage assembly would be at the bottom of the slider shaft.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. An apparatus for communicating exercise resistance comprising:

a first carriage assembly having upper and lower pulleys rotatably mounted thereon;

a first cable end having a coupling, said coupling disposed between the upper pulley and lower pulley;

a second cable end releasably attached to the first carriage;

a selectable exercise resistance coupled to the first and second cable ends so as to resist the first cable end being drawn out from between the upper and lower pulleys;

a second carriage assembly having an exercise member associated therewith;

the second carriage assembly having attachment locations for selectively attaching the first and second cable ends;

whereby movement of the exercise member moves the second carriage assembly and is subject to a first exercise resistance when the first cable end is attached to the second carriage assembly and is subject to a second exercise resistance when the first and second cable ends are both attached to the second carriage assembly.

2. The apparatus of claim 1 wherein the carriage assemblies are mounted on support members of the exercise apparatus.

3. The apparatus of claim 2 wherein the first carriage assembly is selectively positionable along the support member of the exercise apparatus.

4. The apparatus of claim 1 wherein the first and second cable ends are opposite ends of a single cable.

5. The exercise apparatus of claim 1 wherein the second carriage assembly is one of a pair of second carriage assemblies arranged to exercise left and right sides of a human body.

6. An exercise apparatus comprising:

a frame;

a source of exercise resistance;

a first carriage assembly mounted on a support member coupled to the frame, the first carriage assembly having upper and lower pulleys rotatably mounted thereon;

a first cable end having a coupling, said coupling disposed between the upper and lower pulleys;

a second cable end releasably attached to the first carriage assembly;

the source of exercise resistance coupled to the first and second cable ends;

a second carriage assembly mounted on the support member coupled to the frame, the second carriage assembly having attachment locations for selectively attaching the first and second cable ends;

an exercise member coupled to the second carriage assembly;

whereby movement of the exercise member moves the second carriage assembly and is subject to a first exercise resistance when the first cable end is attached to the second carriage assembly and is subject to a second exercise resistance when the first and second cable ends are both attached to the second carriage assembly.

7. The apparatus of claim 6 wherein the first and second cable ends are opposite ends of a single cable.

8. The apparatus of claim 6 wherein the first carriage assembly is selectively positionable along the support member of the exercise apparatus.

9. The exercise apparatus of claim 6 wherein the first carriage assembly is one of a pair of carriage assemblies arranged to exercise left and right sides of a human body.

* * * * *